United States Patent [19]

Takizawa et al.

[11] 4,253,761

[45] Mar. 3, 1981

[54] CLEANING DEVICES FOR USE IN ELECTROPHOTOGRAPHIC APPARATUS

[75] Inventors: Tatsuji Takizawa, Yokohama; Nobutaka Noda, Kawasaki, both of Japan

[73] Assignee: Kabushiki-Kaisha KIP, Tokyo, Japan

[21] Appl. No.: 785,249

[22] Filed: Apr. 6, 1977

[30] Foreign Application Priority Data

Apr. 17, 1976 [JP] Japan ..... 51-44116

[51] Int. Cl.[3] ..... G03G 21/00

[52] U.S. Cl. ..... 355/15

[58] Field of Search ..... 355/15; 134/1, 6

[56] References Cited

U.S. PATENT DOCUMENTS

| | | | |
|---|---|---|---|
| 3,510,903 | 5/1970 | Stoever et al. | 355/15 X |
| 3,672,764 | 6/1972 | Hartwig et al. | 355/15 |
| 3,776,632 | 12/1973 | Smith et al. | 355/15 |
| 3,792,925 | 2/1974 | Milligan et al. | 355/15 |
| 3,807,853 | 4/1974 | Hudson | 355/15 |
| 3,815,989 | 6/1974 | Davis et al. | 355/15 X |
| 3,867,170 | 2/1975 | Ferguson et al. | 134/6 X |
| 3,884,572 | 5/1975 | Bacon et al. | 355/15 |
| 3,980,494 | 9/1976 | Beatty et al. | 134/6 |

*Primary Examiner*—A. D. Pellinen

*Attorney, Agent, or Firm*—Cushman, Darby & Cushman

[57] ABSTRACT

A cleaning device for use in an electrophotographic apparatus for removing developer toners remaining on the surface of the photosensitive element after transfer printing a developed image therefrom to a receptor sheet. The cleaning device is provided with a cleaning device comprising a resilient inner member and an outer member provided thereon and frictionally contacted with the element to generate triboelectrical charges of opposite polarity to that of charges existing on the photosensitive element, at the time of being in frictional contact therewith.

10 Claims, 9 Drawing Figures

33
36
35
43
41
42
39
34
44
37
40
38

CLEANING DEVICES FOR USE IN ELECTROPHOTOGRAPHIC APPARATUS

BACKGROUND OF THE INVENTION

This invention relates to a cleaning device for use in an electrophotographic apparatus for removing developer toners remaining on a photosensitive element.

In an ordinary electrophotographic apparatus, an electrostatic charge pattern corresponding to a light and dark image of an original to be reproduced is formed by suitable means on a photosensitive element and then developed by depositing developer toners thereon. After being transferred by suitable means onto a receptor sheet the developed image is fixed by fixing means to the sheet to form a finally reproduced image. The developer toners remaining on the element are removed by a cleaning device therefrom so that the photosensitive element is ready for repeated use.

A cleaning device has hitherto been known which has a cleaning member comprising a brush, an elastic blade or an elastic roller to be placed in sliding contact with the photosensitive element to remove the developer remaining thereon. Such a cleaning device has disadvantages that toners or carriers are apt to be attached to the cleaning member and thus there is a difficulty in keeping its high cleaning ability for a long period, and that the cleaning member has to be contacted with the photosensitive element under a relatively high pressure thereby resulting in the damage of the photosensitive element and the decrease in the life thereof.

SUMMARY OF THE INVENTION

It is an object of the present invention to provide an improved cleaning device for use in an electrophotographic apparatus in which the above-described disadvantages of the conventional device are removed.

It is another object of the present invention to provide a cleaning device for use in an electrophotographic apparatus having a simple and convenient construction.

According to the present invention, there is provided a cleaning device for use in an electrophotographic apparatus for removing toner remaining on a surface of a photosensitive element wherein there is provided a cleaning means comprising a resilient inner member driven relative to said element, an outer member provided on said member and contacted with said element under the resilience of said inner member, and said outer member being formed of a material which generates triboelectrical charges of a polarity opposite to the polarity of the charges deposited on the surface of said element moving to the contact point with said outer member, thereby transferring the toner from said element to said outer member, and there being further provided scraping means contacted with said outer member to remove the toner therefrom.

DESCRIPTION OF THE PREFERRED EMBODIMENTS

Figure 1:
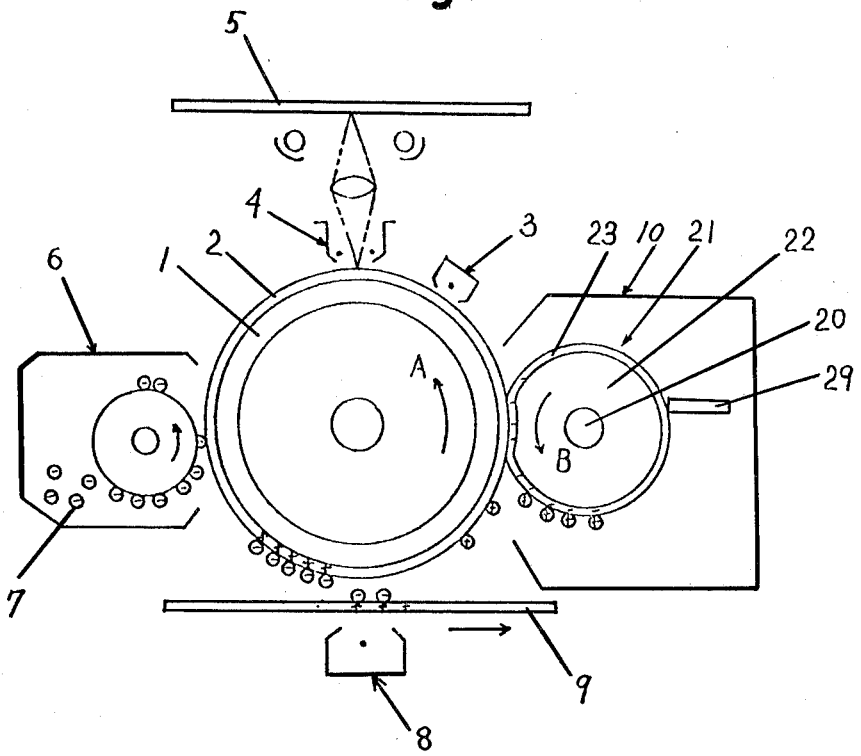
FIG. 1 is a schematic side view of an example of an electrophotographic apparatus incorporated with a cleaning device according to the present invention.

Referring first to FIG. 1, there is shown an electrophotographic apparatus in which a cleaning device of the present invention is incorporated. A drum 1 which is made of an electrically conductive material, for example aluminium, is provided in the apparatus to be rotatable in a direction of an arrow A. Secured to the peripheral surface of the drum 1 is a photosensitive element 2 on which an electrostatic latent image corresponding to an original to be reproduced is formed. In this example, the photosensitive element 2 comprises an electrode layer, a photoconductive layer including cadmium sulfide powder, an electrically insulating layer of polyethyleneterephthalate, and these layers being integrally bonded in the order mentioned above. The electrode layer of the element 2 is fixed to the drum 1 by a suitable adhesive.

Provided adjacent to the surface of the insulating layer of the element 2 are corona discharge devices 3 and 4 which emit positive and negative ions, respectively, to the element. As the element 2 rotates in the direction of the arrow A, it is subjected to the corona discharge from the devices 3, 4 and to the projection of a light-dark image of an original 5 through the corona discharge device 4, thereby forming a positive electrostatic charge pattern corresponding to the original on the surface of the insulating layer of the element 2. The resulting charge pattern is then developed by a developing device 6.

The developing device 6 is of a well-known construction and contains a large amount of toners 7 and carriers. In this example, the carriers are made of glass or iron beads and the toners 7 are triboelectrically charged to negative when they are rubbed against the aforementioned carriers. The toners 7 are brought into contact with the surface of the insulating layer of the element 2 so that an appropriate amount of the toners 7 is attracted to the surface of the insulating layer thereby developing the charge pattern formed thereon. The toner image or developed image so formed on the surface of the insulating layer is then transferred to a receptor sheet 9 under the action of a transfer corona discharge device 8 emitting positive corona ions. The toner image transferred onto the receptor sheet 9 is fixed thereto by a suitable fixing device (not shown) to form a permanent picture on the sheet.

It is usual that a small amount of toners remains on the surface of the insulating layer of the element 2, after the toner image has been transferred to the receptor sheet 9. In order to re-use the element 2, the toners remaining on its surface are to be removed therefrom by a cleaning device 10.

Figure 2:
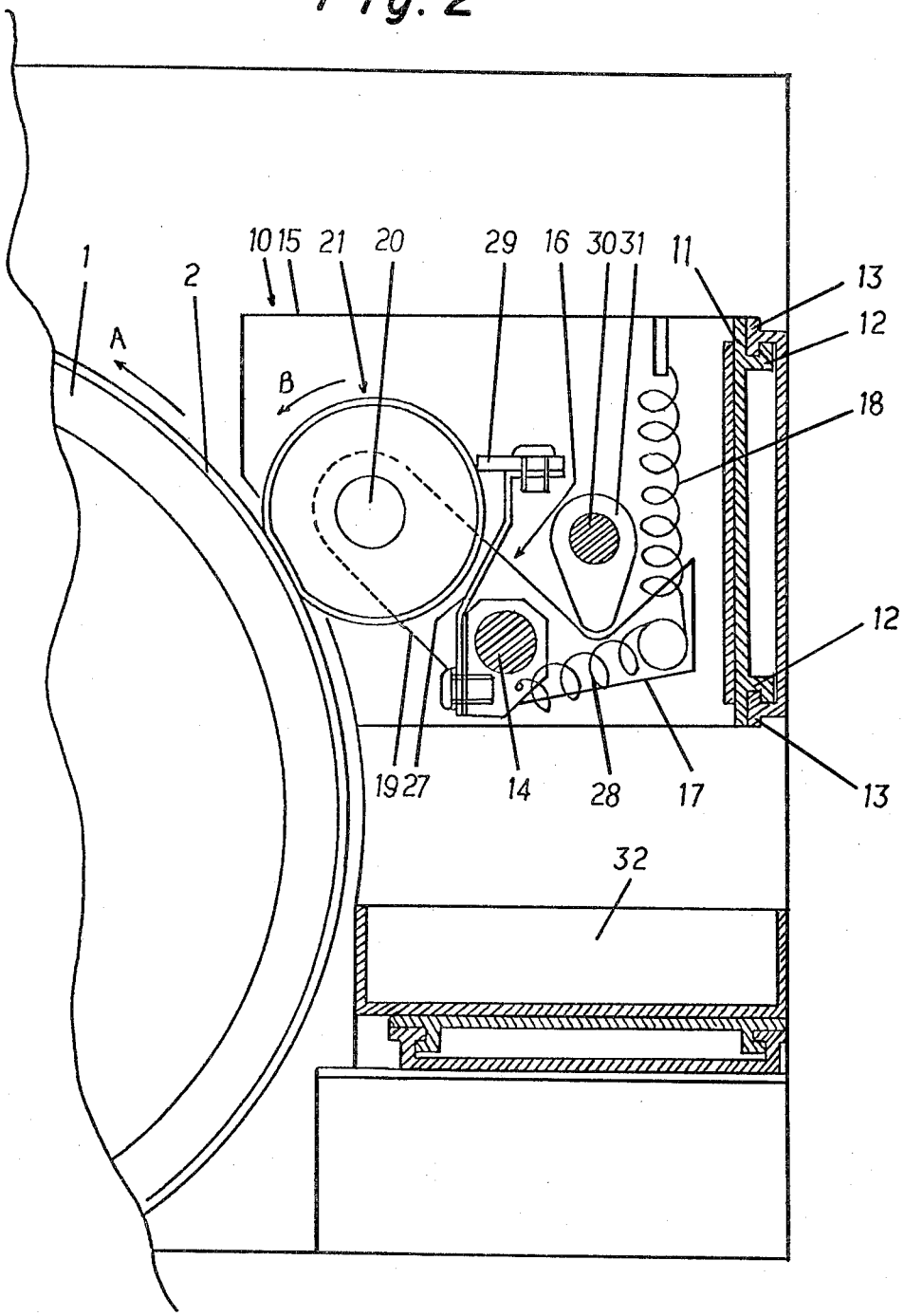
FIG. 2 is a side view of one embodiment of the device according to the present invention.

As shown in FIG. 2, the cleaning device 10 includes a frame 11 which is provided on its back side with a pair of L-shaped projections 12 each having a concave portion. The projections 12 are slidably engaged with a pair of T-shaped rails 13 which are provided in parallel relationship to each other and fixed to the body of the apparatus. In this example, the rails 13 extend in substantially parallel relation with the axis of the drum 1 so that the frame 11 can move in the direction normal to the sheet of the drawing.

A shaft 14 is fixed to opposite side walls (one of them being shown at the reference numeral 15) of the frame 11, the shaft extending in substantially parallel with the axis of the drum 1 when the cleaning device 10 is located in position (described hereinlater) within the apparatus. A pair of spaced bell crank levers 16 is pivotally mounted on the shaft 14. Each of the levers 16 has a first arm 17 to which a tension spring 18 is fixed at its one end and the other end thereof is secured to the frame 11 such that the lever 16 is urged by the spring in an anti-clockwise direction as viewed in FIG. 2. Each of the levers 16 is provided with a second arm 19, and rotatably mounted on ends of the arms 19 is a shaft 20 which extends in substantially parallel relation with the shaft 14.

Figure 3:
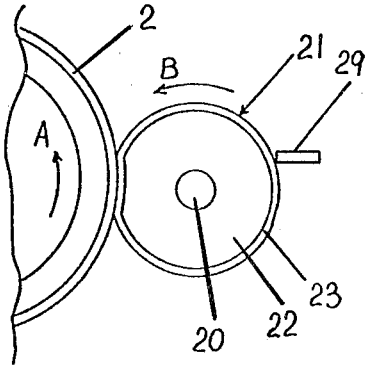
FIGS. 3 and 4 are side views of part of the device of the present invention.
Figure 4:
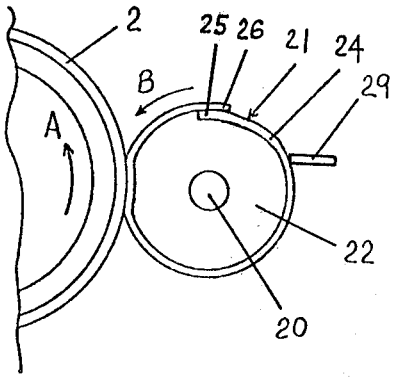

A roller 21 is fixed to the shaft 20. Preferred examples of the roller 21 are shown in FIGS. 3 and 4. The roller 21 of FIG. 3 includes a relatively thick resilient cylinder 22 made of such a material as neoprene rubber, polyurethane rubber, chlorosulfonated polyethylene or felt, and a sleeve-like synthetic resin cover layer 23 provided on the periphery of the cylinder 22, said cover layer 23 preferrably being of about 50–200$\mu$ in thickness and having an inner diameter slightly smaller than the outer diameter of the cylinder 22 such that the layer 23 is fixed to the cylinder 22 by the resilience thereof. The roller 21 has a longitudinal length slightly longer than the axial length of the drum 1 and is contacted under pressure by the springs 18 with the surface of the element 2 when the roller is located in the position of FIG. 2 in such a manner as will be described later. The contact of the roller 21 with the element becomes uniform by the resilience of the cylinder 22.

The roller 21 shown in FIG. 4 is made similar to the roller of FIG. 3, but the only difference lies in that a cover layer 24 is provided by fixing one end 25 of a synthetic resin film by an adhesive to the periphery of the resilient cylinder 22, winding the film along the periphery of the cylinder 22 in a direction opposite to the direction B of rotation of the roller 21 and overlapping at least the opposite end portion 26 of the film upon the end portion 25 of the film.

Pivotally provided on the opposite end portions of the shaft 14 is a pair of second levers 27 each of which is urged in the anti-clockwise direction as viewed in FIG. 2 by a tension spring 28 provided between the lower end portion of the lever 27 and the arm 17 of the lever 16. A scraping member 29 is fixed to the upper portion of the lever 27. The scraping member 29 may be of metal, rubber or synthetic resin material and has a longitudinal length slightly longer than that of the roller 21, the forward edge of the member 29 being in contact with the outer surface of the roller 21 under the action of the springs 28.

Rotatably supported by the opposite side walls 15 of the cleaning device 10 is a shaft 30 which extends in substantially parallel with the shaft 14. The shaft 30 has fixed thereto a pair of the third levers 31, ends of the respective levers 31 being positioned adjacent to the respective concave portions of the bell crank levers 16. With such an arrangement, when the shaft 30 is rotated in the anti-clockwise direction by holding and moving a handle (not shown) fixed to one end of the shaft 30, the levers 31 are pivotally moved in the anti-clockwise direction to be brought into engagement at their ends with the upper surface of the arm 17 of the lever 16, whereby the lever 16 is rotated in the clockwise direction against the action of the spring 18 to separate the roller 21 from the surface of the element 2.

A gear (not shown) is fixed to one end of the shaft 20 in such a manner that when the device 10 is located in position within the apparatus the gear is engaged with a driving gear (not shown) rotatably mounted on a fixed wall (not shown) of the body of the apparatus to drive the roller 21 at an appropriate speed in the direction of the arrow B of FIG. 2. Since the axis of the driving gear is in co-axial relation to that of the shaft 14, the gear secured to the shaft 20 is not disengaged from the driving gear, even when the levers 16 pivotally move. It is preferable to drive the roller 21 at a relatively low speed such that the peripheral speed of the roller 21 falls within a range of 1/10 to 1/30 of that of the drum 1.

A box 32 which is open at its upper portion thereof is provided below and separately from the cleaning device 10 and detachably disposed in the body of the apparatus to receive the toners removed from the surface of the element 2 by the cleaning device 10. The box 32 is adapted to be pulled out to easily dispose of the toners stored therein.

In use, the handle of the shaft 30 is rotated to engage the ends of the levers with the upper surfaces of the associated arms 17 thereby pivotally moving the levers 16 from the position of FIG. 2 in the clockwise direction, and in this condition the projections 12 of the frame 11 are engaged with the respective rails 13 to move the device 10 along the rails 13 to the predetermined position within the body of the electrophotographic apparatus. At this position, the frame 11 is then fixed by bolts to the body of the apparatus. The handle of the shaft 30 is then rotated in the opposite direction to pivotally move the levers 31 in the clockwise direction so that the ends of the levers 31 return into the concave portions of the levers 16 which, in turn, are pivotally moved under the action of the springs 18 in the anti-clockwise direction to the position shown in FIG. 2 and thus the roller 21 is contacted under pressure with the surface of the element 2.

The drum 1 is rotated in the direction of the arrow A, and at the same time the roller 21 is rotated in the direction of the arrow B. In so doing, the toners remaining on the surface of the insulating layer of the element 2 are removed therefrom and transferred onto the surface of the roller 21 as is described herein later. The toners transferred are carried by the roller 21 without dropping therefrom and then removed by the scraping member 29 from the roller to fall into the box 32. When it is desired that the cleaning device 10 is detached from the body of the apparatus, for example, to replace the roller 21 with new one, this can be achieved by the reverse sequence to that of mounting the device 10 as described above.

In another embodiment of the present invention, the second levers 27 are pivotally mounted on a further shaft (not shown) provided on the bell crank lever 16, each of the levers 27 being biased by a spring provided between the levers 16 and 27 as is the case of the spring 28 shown in FIG. 2, thereby contacting the scraping member 29 with the peripheral surface of the roller 21.

The cover layers 23 and 26 of the rollers 21 of the cleaning device according to the present invention are made of a material which, when it is brought into frictional contact with the material forming the surface layer of the element 2, is triboelectrically charged to have charges of a polarity opposite to that of the charges existing on the surface of the element 2. In an ordinary electrophotographic apparatus, a substantial amount of toners remaining on the surface of the element is charged to the same polarity as that of the charges on the surface of the element so that the toners can easily be transferred from the surface of the element to the surface of the roller 21 by the action of the triboelectrical charges generated on the cover layer of the roller 21 and, in addition, by the mechanical separation of the toners caused by the contact of the cover layer of the roller 21 therewith. The toners transferred to the roller are carried by it while remaining attached thereto, and then removed by the scraping member 29 therefrom.

In the apparatus of FIG. 1, the outer layer of the photosensitive element 2 is made of polyethyleneterephthalate film and an electrostatic latent image of positive polarity is formed thereon. It is, therefore, required that the cover layer 23 of the roller 21 to be used in this apparatus is made of such a synthetic resin material that triboelectrical charges having a possibly high potential of negative polarity are generated thereon by its frictional conact with the polyethyleneterephthalate film. Polyethylene is one of the suitable materials which satisfy such requirements. Accordingly, the cover layer 23 of the roller 21 to be used in the apparatus of FIG. 1 may be triboelectrically charged to negative polarity of more than several hundreds volts, when it is frictionally contacted with the polyethyleneterephthalate. In practice, the polyethylene cover layer of the roller 21 is triboelectrically charged up to minus several hundreds volts, when it is rubbed against the polyethyleneterephthalate insulating layer of the element 2 on which an electrostatic charge pattern of about plus 700 volts has been formed, and thus the effect of removing toners is extremely high. It is further effective that the scraping member 29 which is contacted with the cover layer of the roller 21 is also made of a material which generates thereon triboelectrical charges of such polarity as is described above.

Figure 5:
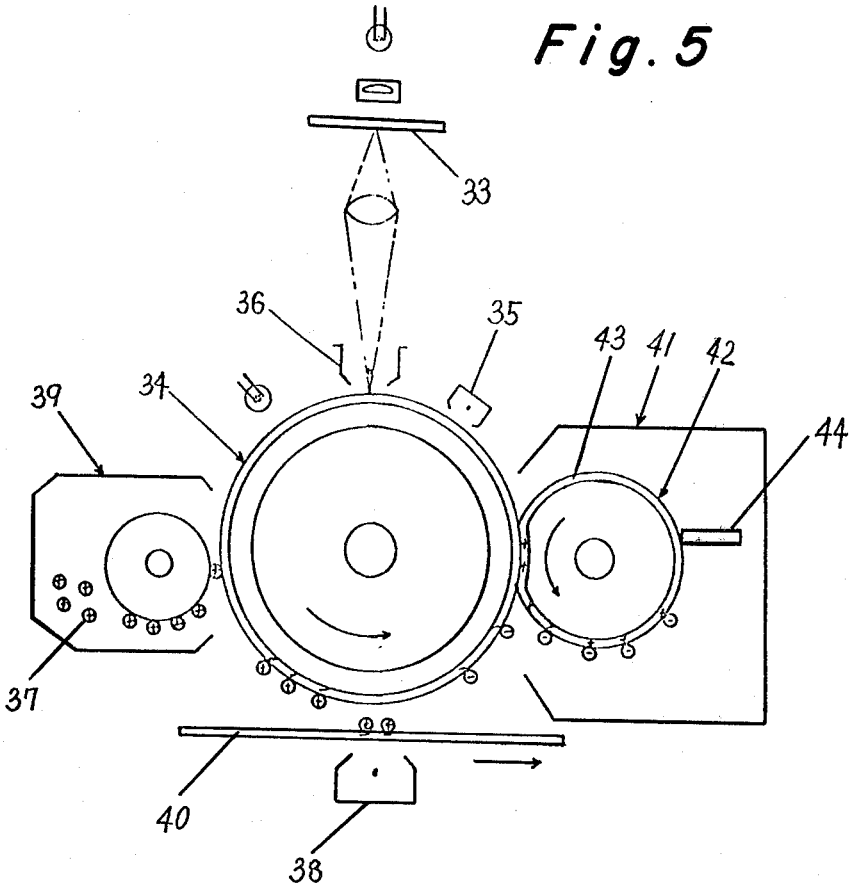
FIG. 5 is a schematic side view of another example of an electrophotographic apparatus incorporated with another cleaning device according to the present invention.

An apparatus shown in FIG. 5 is to form a positive picture from a negative original image 33, and its photosensitive element 34 and corona discharge devices 35 and 36 are similar to the photosensitive element 2 and the corona discharge devices 3 and 4, respectively, of the apparatus of FIG. 1. However, developer toners 37 are to be triboelectrically charged to positive and a transfer corona device 38 is to generates negative ions. In this example, accordingly, the toners 37 deposited by a developing device 39 on the light portion of the electrostatic charge pattern formed on the element 34, i.e. the negative potential portion of the element 34 to form a toner image which is, in turn, transferred to a receptor sheet 40 by the corona discharge device 38. With such an arrangement, a substantial amount of the toners remaining on the element 34 and carried thereby towards a cleaning device 41 is charged to negative polarity.

A roller 42 of the cleaning device 41 is constructed similarly to the rollers 21 of FIGS. 3 and 4, but a cover layer 43 of the roller 42 is made of such a material that it generates positive triboelectrical charges thereon, when it is fricitionally contacted with the polyethyleneterephthalate outer layer of the element 34. Polyamide resin is one of the materials suitable for the cover layer 43. Accordingly, the layer 43 is made of polyamide resin sleeve or film.

With such an arrangement, the toners remaining on the surface of the photosensitive element are easily removed therefrom by the action of the triboelectrical charges generated on the cover layer 43 of the roller 42 as well as by the mechanical separation of the toners therefrom caused by the contact of the cover layer therewith, and the toners are transferred onto the cover layer 43 of the roller 42. The toners so transferred to the cover layer are then removed therefrom by a scraping member 44 which is in sliding engagement with the layer under pressure.

A practical experiment was made in which the right and left half portions of the cover layer 23 of the roller 21 provided in the apparatus of FIG. 1 were formed of polyethylene and polyamide sleeves, respectively, and driven under the same condition. As a result, the surface portion of the element contacted with the polyethylene sleeve was completely cleaned and on the other hand the surface portion of the element contacted with the polyamide sleeve was not cleaned while a relatively amount of the toners remained attached to the surface portion. A further experiment was made in which this roller was incorporated in the apparatus of FIG. 5. As a result, the surface portion of the element contacted with the polyamide sleeve was completely cleaned, but the surface portion of the element contacted with the polyethylene sleeve was not cleaned while a relatively large amount of the toners remained attached to the surface portion.

Figure 6:
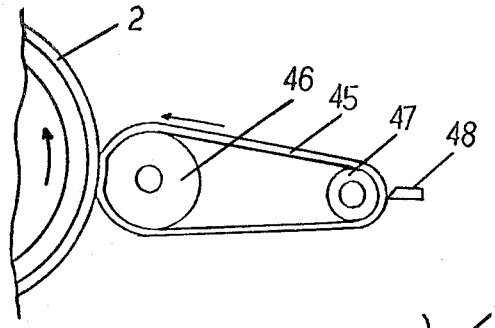
FIGS. 6, 7, 8 and 9 are side views showing modifications of a part of the device according to the present invention.

FIGS. 6 to 9 show modifications of the cleaning device according to the present invention. In the modification of FIG. 6, a belt 45 of a synthetic resin material is engaged with a pair of rollers 46 and 47. The roller 46 is made of a sponge rubber and driven to move the belt 45 in a direction of an arrow, while contacting the latter with the surface of the photosensitive element 2 under pressure. A scraping member 48 is placed opposite to the roller 47 and in engagement with the belt 45 to remove the toners from the outer surface thereof.

Figure 7:
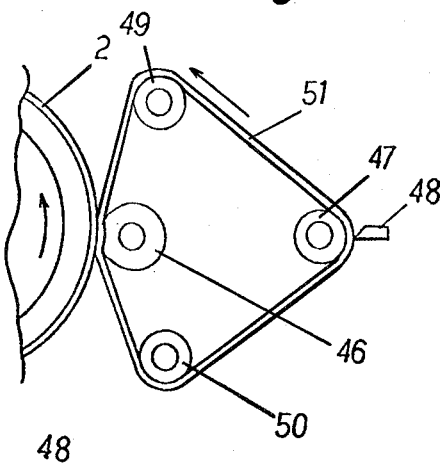

In FIG. 7, the cleaning device is constructed similar to that of FIG. 6 except that there are provided further rollers 49 and 50 mounted so as to increase the contact area between a belt 51 and the element 2.

Figure 8:
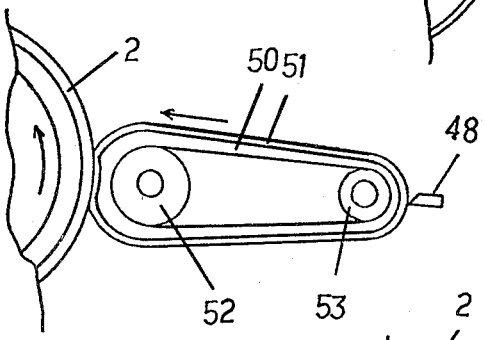

The device of FIG. 8 is arranged such that the cleaning member comprises a resilient rubber belt 50, a synthetic resin cover layer 51 overlaid thereon and the belt being engaged with a pair of metallic rollers 52 and 53.

Figure 9:
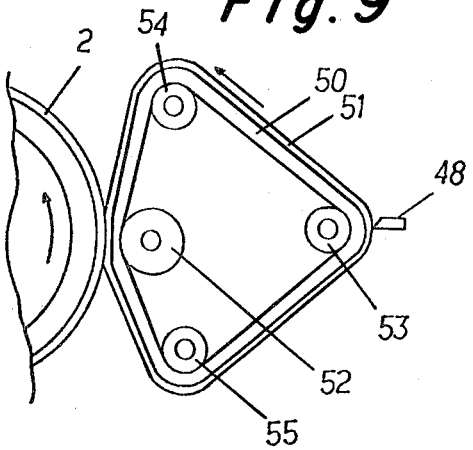

The device of FIG. 9 includes a pair of further metallic rollers 54 and 55 in addition to the device of FIG. 8.

In the above modifications, the belts 45, 51 and the cover layers 51 are to be made of synthetic resin material having the physical and electrical properties described hereinbefore in relation to the material of the outer layer of the element 2, and the rollers are rotatably mounted on extensions formed on the arms 19 of the respective levers 16.

The outer surface layer of the cleaning member for removing the developer from the photosensitive element is made of such a synthetic resin material that the toners can not enter thereinto, but is only attracted thereto, such that the toners can be removed from the surface layer by the contact of the scraping member therewith under a relatively low pressure. Accordingly, the cleaning member is able to have a high cleaning ability for a long period and is driven by a relatively low driving power. In the present invention, furthermore, the mechanism of removing the toner from the surface of the photosensitive element is mainly dependent upon the action of the triboelectrical charges generated on the outer surface layer of the cleaning member so that the contact force of the cleaning member with the photosensitive element can be fairly reduced in comparison with the conventional cleaning device, and thus there is no risk to damage the photosensitive element.

What is claimed is:

1. A cleaning device for use in an electrophotographic apparatus which has a photosensitive element provided with a surface layer of polyethyleneterephthalate on which a toner image of positive polarity is formed, characterized in that there is provided a cleaning means comprising a resilient inner member driven relative to said element and an outer member made of a polyethylene material into which toner can not enter and provided on said inner member to contact with said surface layer of said element such that triboelectrical charges of negative polarity are generated on said outer member thereby transferring the residual toner on said surface layer of said element to said outer member, and there being further provided a scraping member engaged with said outer member to remove the toner therefrom.

2. A cleaning device as set forth in claim 1 wherein said cleaning means is rotatably mounted on a first lever which is pivotally disposed in the device and spring biased to cause the contact of said outer member of the cleaning means with the photosensitive element, and said scraping member fixed to a second lever which is also pivotally disposed in the device and spring biased to cause the contact of said scaping member with said outer member of said cleaning means.

3. A cleaning device as set forth in claim 2 wherein there is further provided a third lever engageable with said first lever to pivotally move the latter against the action of the spring associated therewith, thereby disengaging said cleaning means from the photosensitive element.

4. A cleaning device as claimed in claim 1 wherein said inner member is a rubber cylinder fixed to a rotary shaft and said outer member is made of a sleeve of said polyethylene material held under resilience on the periphery of said cylinder.

5. A cleaning device as claimed in claim 1 wherein said outer member is made of a polyethylene film which is fixed at one end to said inner member and wound along the periphery thereof in a direction opposite to that of rotation of said inner member.

6. The cleaning device as claimed in claim 1 wherein said inner member is a rubber cylinder fixed to a rotary shaft, said outer member being made of a belt of said polyethylene material and said belt being rotatably supported by said cylinder and by at least one roller to contact under the resilience of said cylinder with the surface of said photosensitive element.

7. A cleaning device for use in an electrophotographic apparatus which has a photosensitive element provided with a surface layer of polyethyleneterephthalate on which a toner image of negative polarity is formed, characterized in that there is provided a cleaning means comprising a resilient inner member driven relative to said element and an outer member made of a polyamide material into which toner can not enter and provided on said inner member to contact with said surface layer of said element such that triboelectrical charges of positive polarity are generated on said outer member thereby transferring the residual toner on said surface layer of said element to said outer member, and there being further provided a scraping member engaged with said outer member to remove the toner therefrom.

8. A cleaning device as set forth in claim 7 wherein said inner member is a rubber cylinder fixed to a rotary shaft and said outer member is made of a polyamide sleeve held under resilience on the periphery of said cylinder.

9. A cleaning device as set forth in claim 7 wherein said outer member is made of a polyamide film which is fixed at its one end to said inner member and wound along the periphery thereof in a direction opposite to that of rotation of the inner member.

10. A cleaning device as set forth in claim 7 wherein said inner member is a rubber cylinder fixed to a rotary shaft, said outer member being made of a polyamide belt and said belt being rotatably supported by said cylinder and by at least one roller to contact under the resilience of said cylinder with the surface of said photosensitive element.

* * * * *